US006510562B1

(12) United States Patent
Bae et al.

(10) Patent No.: US 6,510,562 B1
(45) Date of Patent: Jan. 28, 2003

(54) TOILET SEAT LIFTING DEVICE

(75) Inventors: Kyong Sup Bae, Elmhurst, NY (US); Kee Sup Shim, New York, NY (US)

(73) Assignee: S. K. Ventures, Inc., Woodside, NY (US)

( * ) Notice: Subject to any disclaimer, the term of this patent is extended or adjusted under 35 U.S.C. 154(b) by 0 days.

(21) Appl. No.: 09/685,129

(22) Filed: Oct. 10, 2000

(51) Int. Cl.[7] ..... A47K 13/10
(52) U.S. Cl. ..... 4/246.1; 4/241
(58) Field of Search ..... 4/241, 246.1, 246.2–246.5

(56) References Cited

U.S. PATENT DOCUMENTS

| | | | | |
|---|---|---|---|---|
| 1,045,927 A | * | 12/1912 | Zeleny et al. | 4/241 |
| 4,491,989 A | * | 1/1985 | McGrail | 4/246.1 |
| 4,985,939 A | | 1/1991 | Otte | |
| 5,020,165 A | | 6/1991 | Huang | |
| 5,138,724 A | * | 8/1992 | Chien et al. | |
| 5,291,618 A | | 3/1994 | Chiang | |
| 5,309,583 A | | 5/1994 | White et al. | |
| 5,327,589 A | | 7/1994 | Rice | |
| 5,371,906 A | | 12/1994 | Tzang | |
| 5,394,570 A | * | 3/1995 | Tzang | |
| 5,404,595 A | | 4/1995 | Carmel | |
| 5,414,876 A | | 5/1995 | Pan | |
| 5,435,016 A | | 7/1995 | Smith et al. | |
| 5,435,017 A | | 7/1995 | Pan | |
| 5,437,063 A | | 8/1995 | Cotham | |
| 5,444,877 A | | 8/1995 | Kumarasurier | |
| 5,659,902 A | * | 8/1997 | Roberts, Jr. | |
| 5,754,985 A | | 5/1998 | Dias | |
| 5,781,933 A | * | 7/1998 | Anderson | |
| 5,875,498 A | | 3/1999 | Joseph | |
| 5,896,592 A | | 4/1999 | Santa Cruz et al. | |
| 5,937,449 A | | 8/1999 | Rey | |
| 5,940,896 A | | 8/1999 | Berring | |
| 5,978,974 A | | 11/1999 | Mullen | |
| 6,014,946 A | | 1/2000 | Rymer | |

FOREIGN PATENT DOCUMENTS

| | | | | |
|---|---|---|---|---|
| GB | 2264330 | * | 6/1993 | 4/246.1 |
| WO | 93/06765 | * | 4/1993 | 4/241 |

* cited by examiner

*Primary Examiner*—Charles R. Eloshway
(74) *Attorney, Agent, or Firm*—Richard B. Klar

(57) ABSTRACT

A toilet lifting apparatus in which a spring mechanism causes a toilet seat to rise after flushing of the toilet. The spring mechanism is controlled by a bolting device which is connected to the spring mechanism at one end and to a cable at another end so that upon flushing the cable moves the bolting mechanism thereby releasing the spring mechanism. The spring mechanism can vary its resiliency which in turn varies the speed by which the toilet seat rises from its seated position upon flushing. A urine guard is also provided.

6 Claims, 8 Drawing Sheets

TOILET SEAT LIFTING DEVICE

BACKGROUND OF THE INVENTION

1. Field of the Invention

The present invention relates to a toilet seat lifting device for lifting a toilet seat from a seated position to a raised up position upon flushing the toilet. In particular the present invention relates a toilet seat lifting device having variable speeds for lifting or for being disengaged from lifting the toilet seat.

2. The Prior Art

Toilet seat lifting devices are known in the art. U.S. Pat. No. 5,437,063 to Cotham relates to an automatic toilet seat lifting apparatus. The invention in Cotham relies on a cable and a counter weight for raising the toilet seat to upward position. This apparatus is far too complex and cumbersome particularly as it requires a counterweight to raise the toilet seat up.

U.S. Pat. No. 5,875,498 relates to a device which raises and lowers lifts a toilet seat and is activated by means of a plurality of linkage arms connected to a flushing foot pedal. Such a device is complex to build and cumbersome and difficult to install and maintain. In addition such a device is useful only for antiquated foot pedal flushing mechanisms.

SUMMARY OF THE INVENTION

It is a principal object of the invention to provide a simple, easy to install, easy to maintain and to replace components, self lifting toilet seat apparatus which provides a solution for toilet stalls for maintaining hygiene in toilet seats at home and in toilet facilities in public places and in transportation vehicles and trains, which only activates after flushing to prevent injury to the person using the toilet.

It is a further object of the invention to provide a toilet seat lifting mechanism having a variable setting mechanism for changing the speed over a range of speeds from fast to slow at which the toilet seat is raised.

It is yet another object of the present invention to provide a toilet seat mechanism which can be disengaged or engaged without needing to remove the mechanism from the toilet.

It is still another object of the present invention to provide a toilet seat mechanism having a urine spread guard.

These objects of the invention are released by providing an invention for a toilet seat lifting device in which a spring mechanism lifts the toilet seat when the spring mechanism is activated and a bolting mechanism retains the spring mechanism in place from being released when the bolting mechanism is in a first, forward position which maintains the spring mechanism from releasing until the the bolting mechanism is moved into a second, retracted position. The invention includes a cable connecting the bolting mechanism to a wire which in turn is connected to the flushing mechanism so that when the wire is pulled by the flushing mechanism during flushing the bolting mechanism is retracted to its second position and the spring mechanism is released causing the toilet seat to move from its seated position to a raised upward position following flushing of the toilet.

Other objects of the present invention will become apparent from the foregoing description and accompanying drawings in which:

Figure 5:
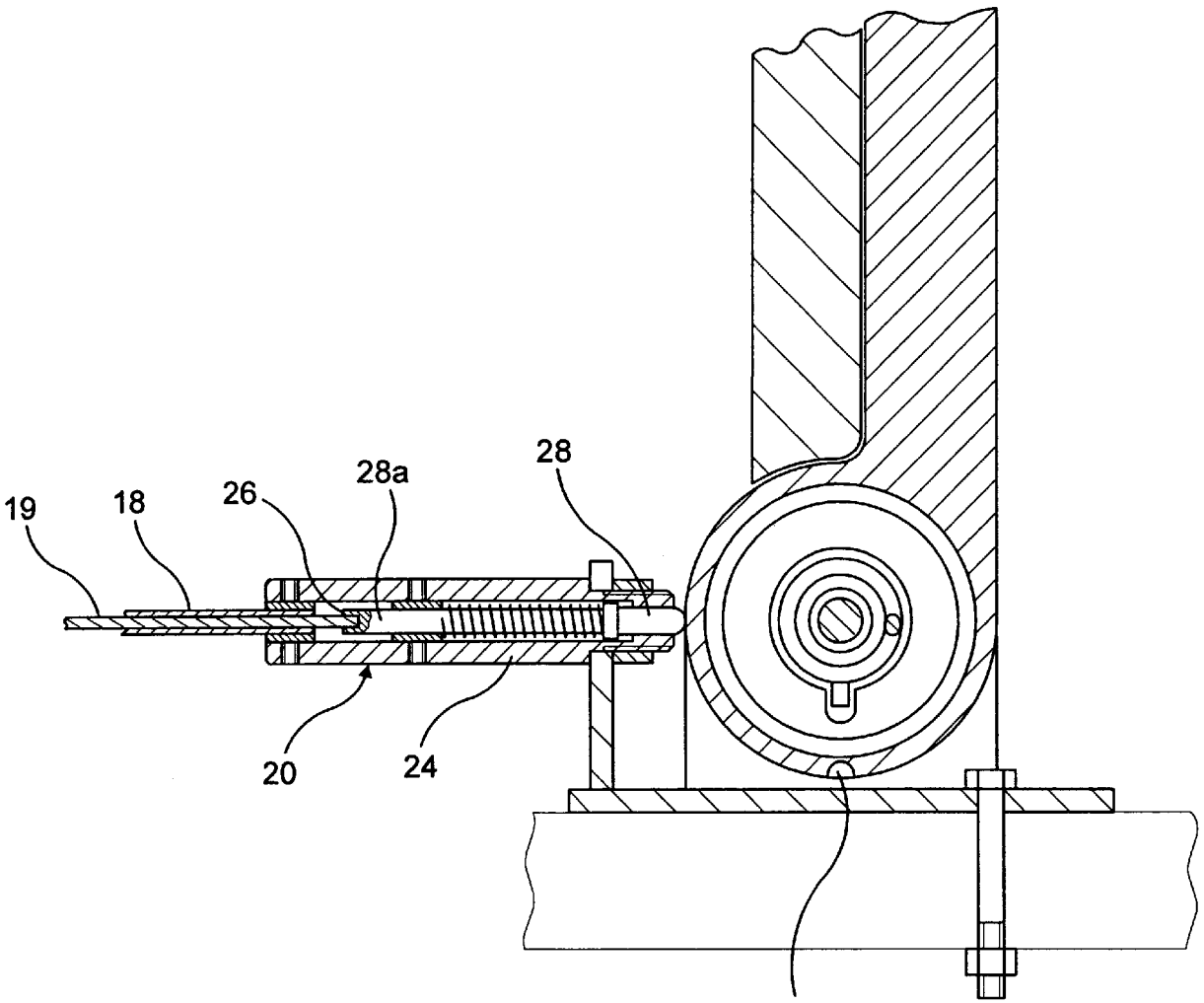
Figure 6A:
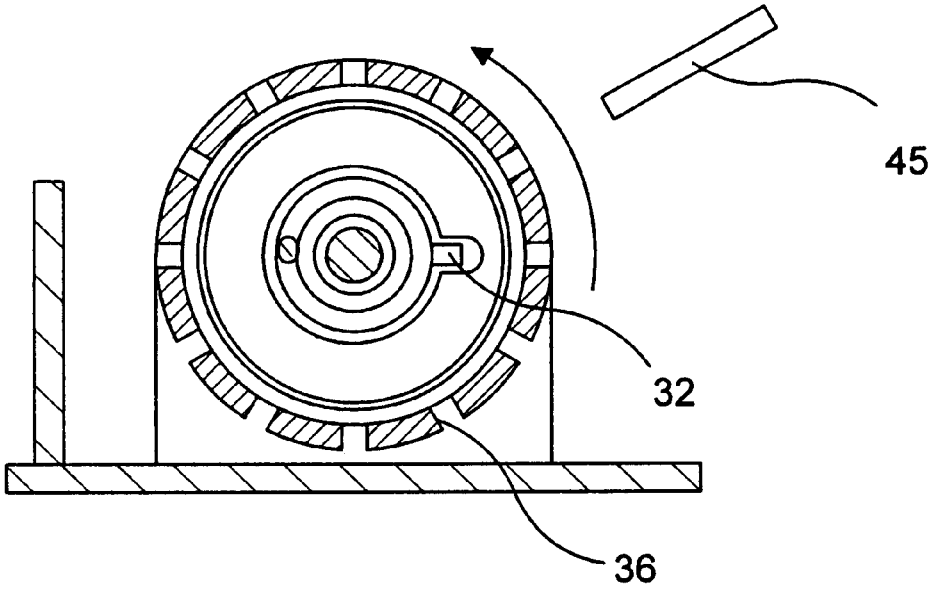
Figure 6B:
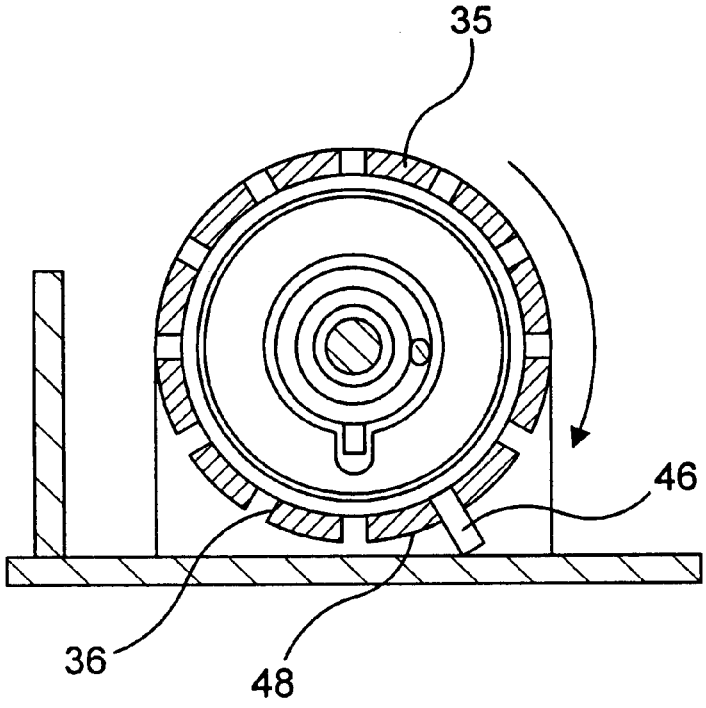
Figure 7:
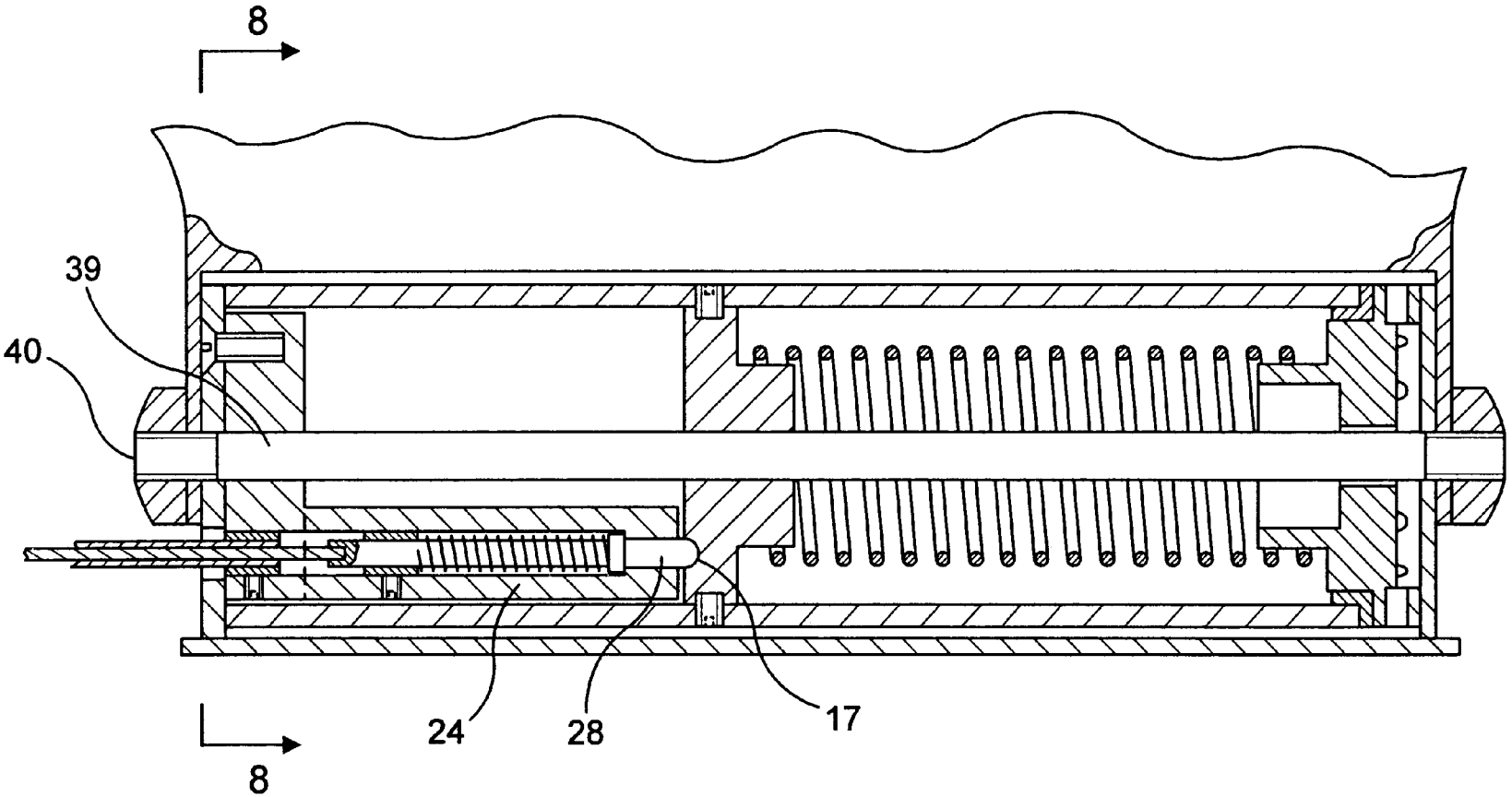
Figure 8:
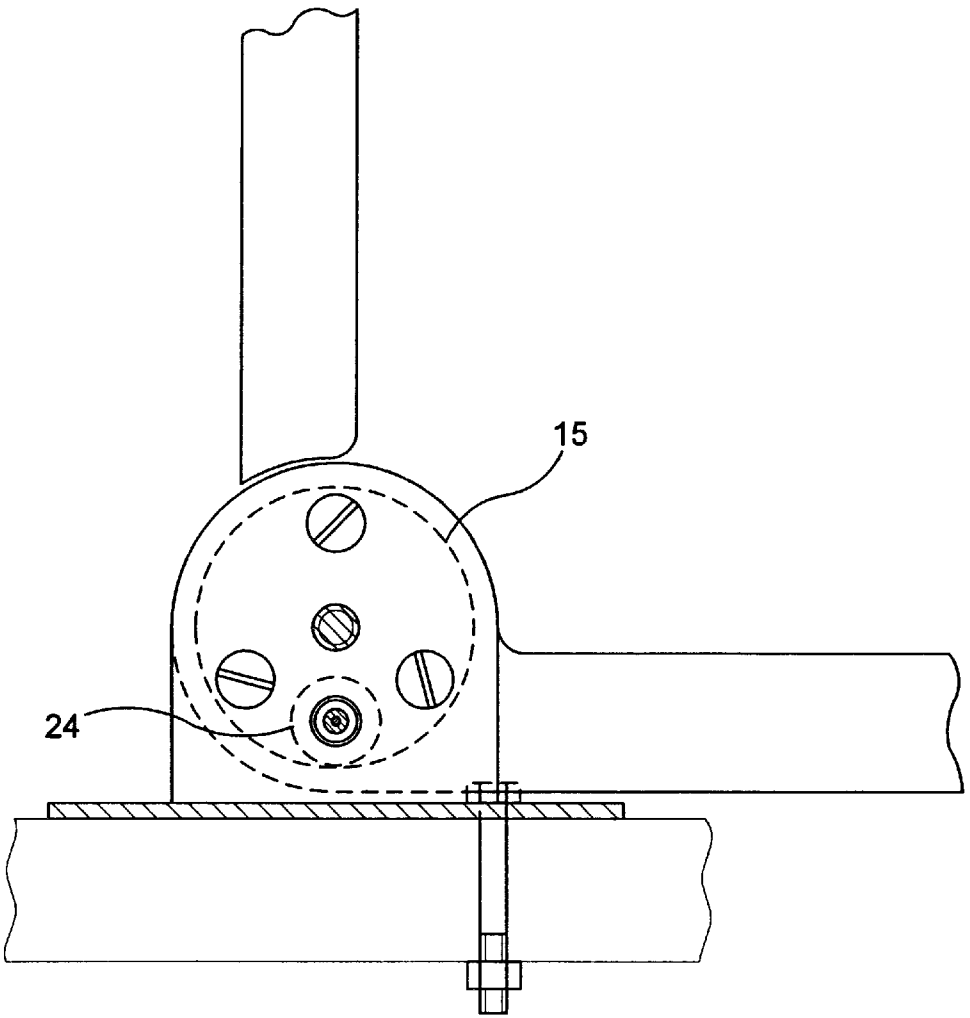

FIG, 5 is a second embodiment of the present invention illustrating the spring mechanism;

FIGS. 6A and 6B shows partial view of the holder for the spring mechanism in which:

FIG. 6A shows how the rod like element is inserted and turned in the direction the bolt (counterclockwise in FIG. 6A) to tighten the resiliency of the spring and increase the speed at which the seat rises; and FIG. 6B shows the key that is inserted into an aperture of the holder underneath the seat in order to maintain the lifting mechanism of the present invention operational;

FIG. 7 is a view taken along lines 5—5 of FIG. 5 showing the bolting mechanism of the second embodiment of the present invention; and FIG. 8 is a partial view taken along lines 8—8 of FIG. 7.

DESCRIPTION OF THE PREFERRED EMBODIMENTS

Figure 1:
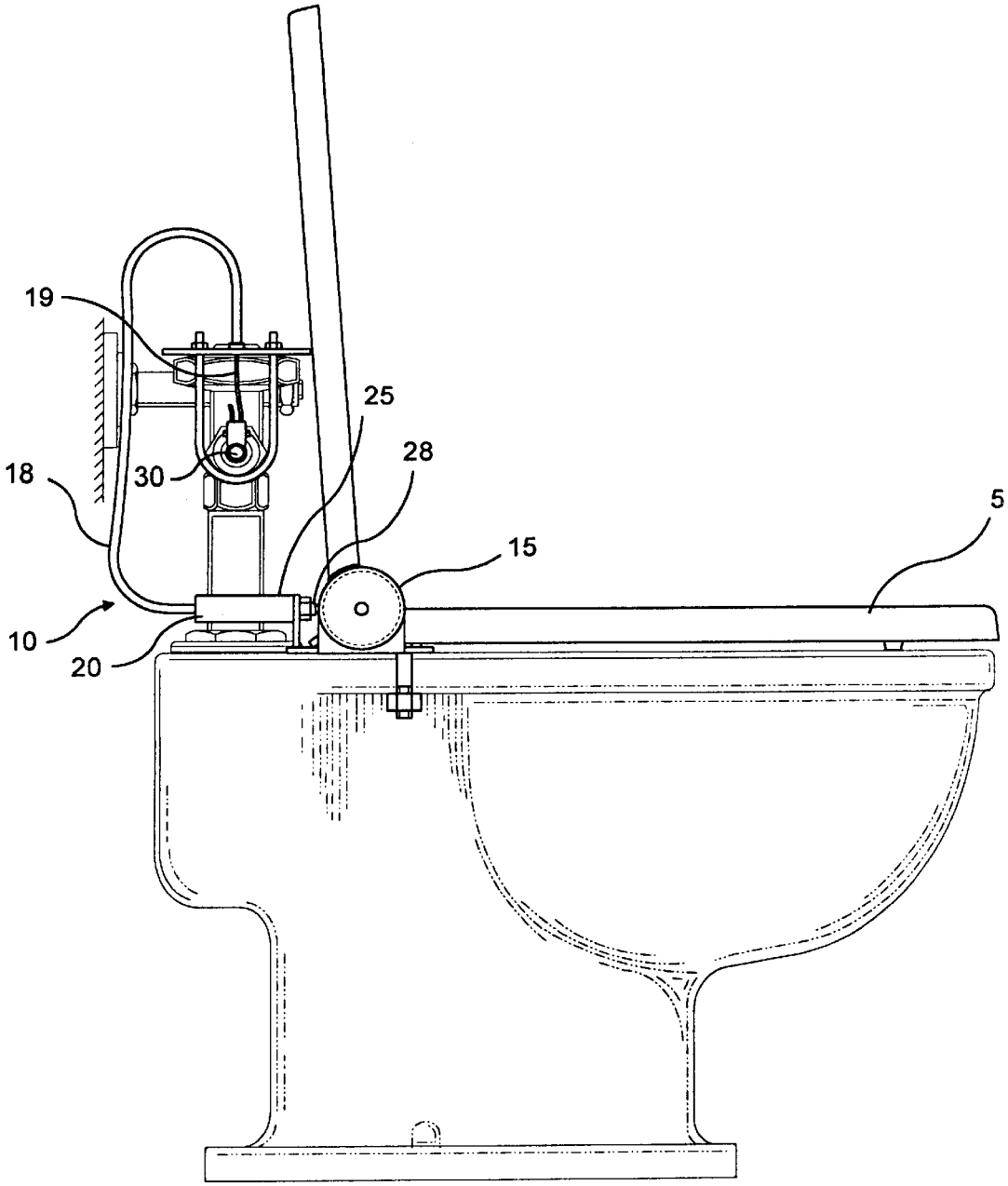
FIG. 1 is a sectional view of the present invention.

Referring now to the drawings and in particular FIG. 1, FIG. 1 illustrates the toilet seat lifting apparatus 10 of the present invention in which the toilet seat 5 has toilet seat lifting apparatus 10 formed of a spring mechanism 15 (see FIGS. 2 and 3), a bolting mechanism 20 including a spring biased catch 28 and a retractable bolt 28 moveable by the spring biased catch's motion against the spring bias by the cable 18.

Figure 2:
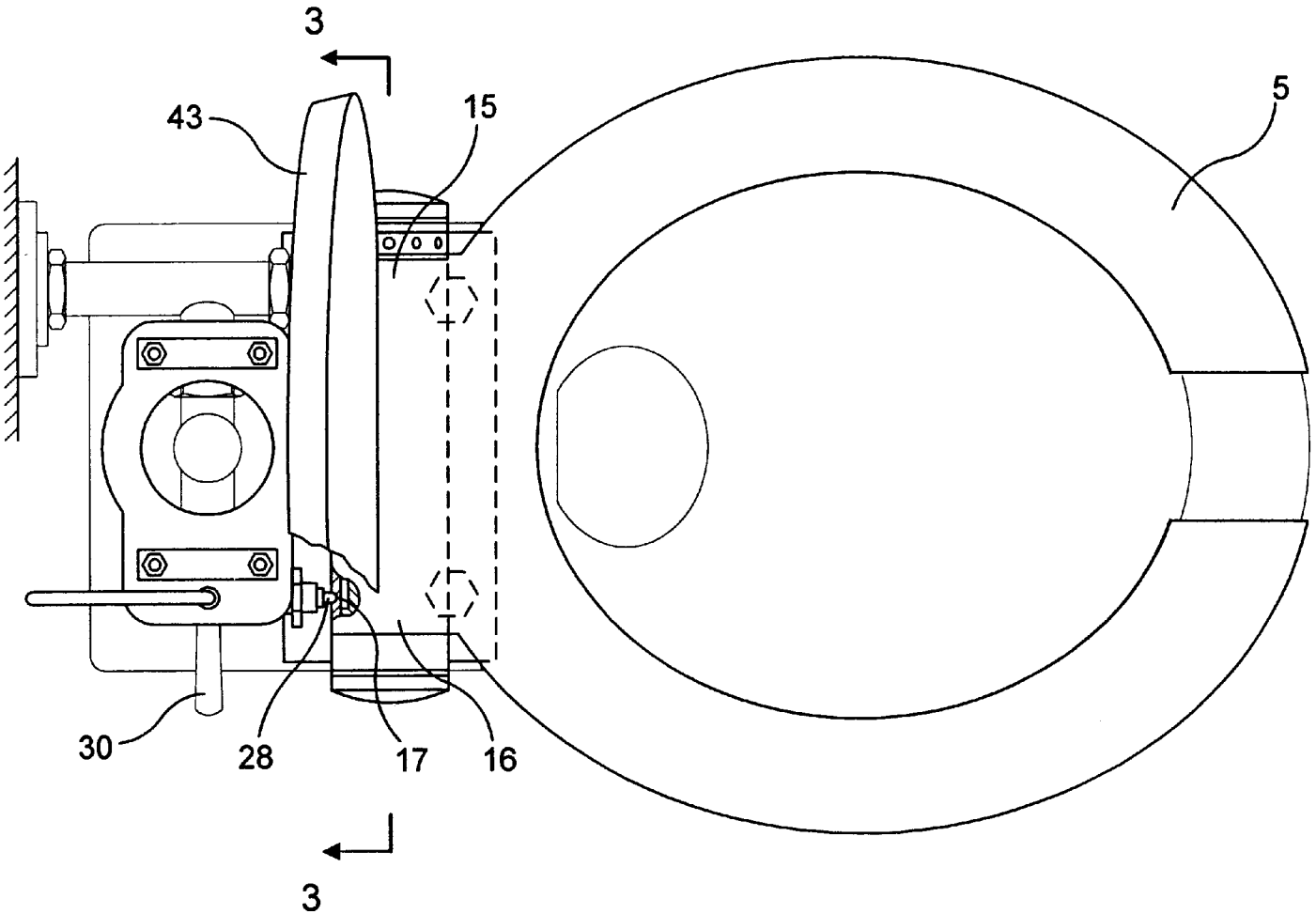
FIG. 2 is a top view of FIG. 1.
Figure 4:
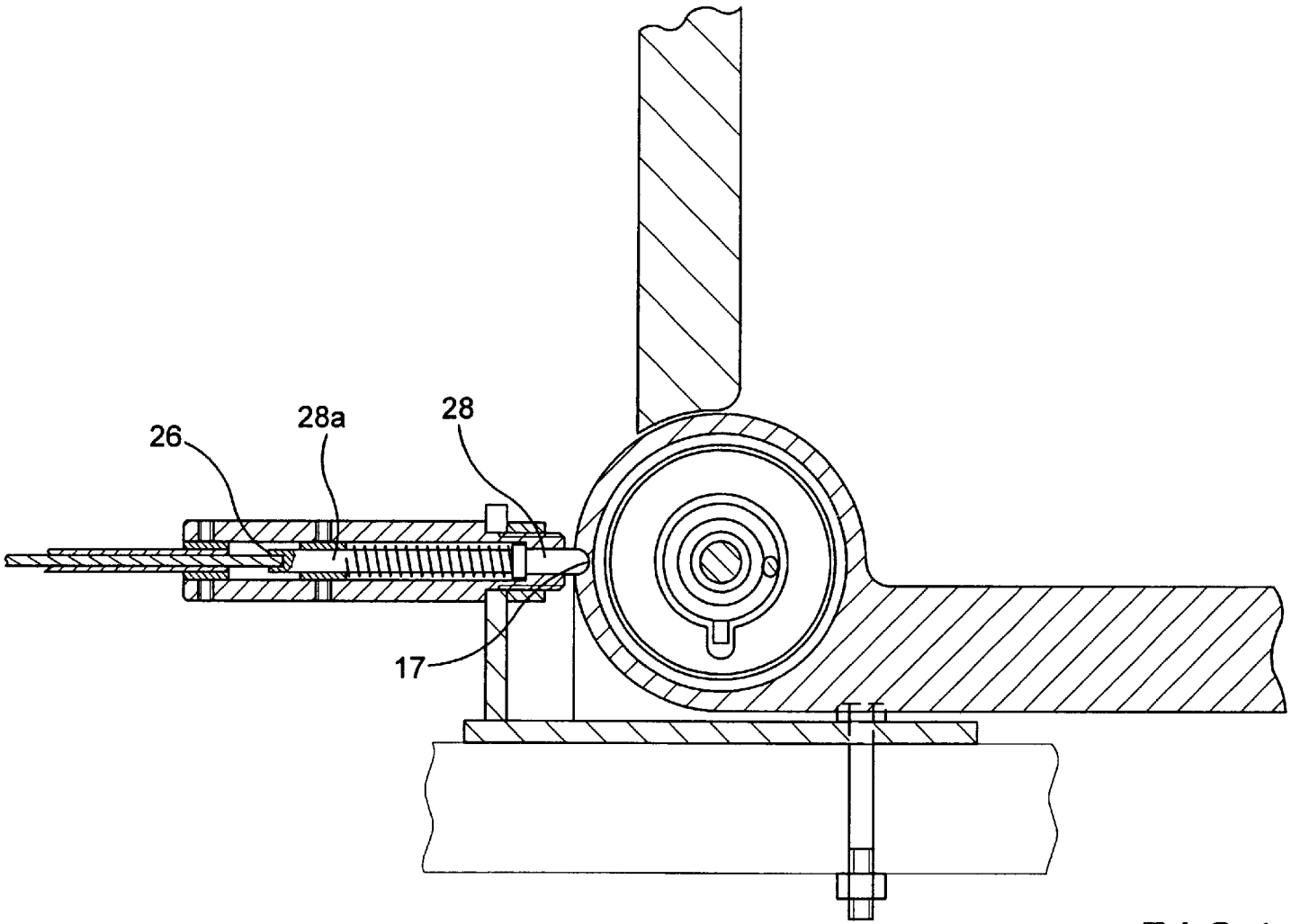
FIG. 4 is a view taken along lines 4—4 of FIG. 3 showing the bolting mechanism of the first embodiment of the present invention.

The bolt 28, as seen in FIG. 2, when advanced into a first position locks into a detente or aperture 17 of the housing cylinder 16 of the spring mechanism 15 holding the spring mechanism 15 in place so that the housing cylinder 16 cannot rotate and cause the seat 5 to rise upward (see FIG. 4).

Figure 3:
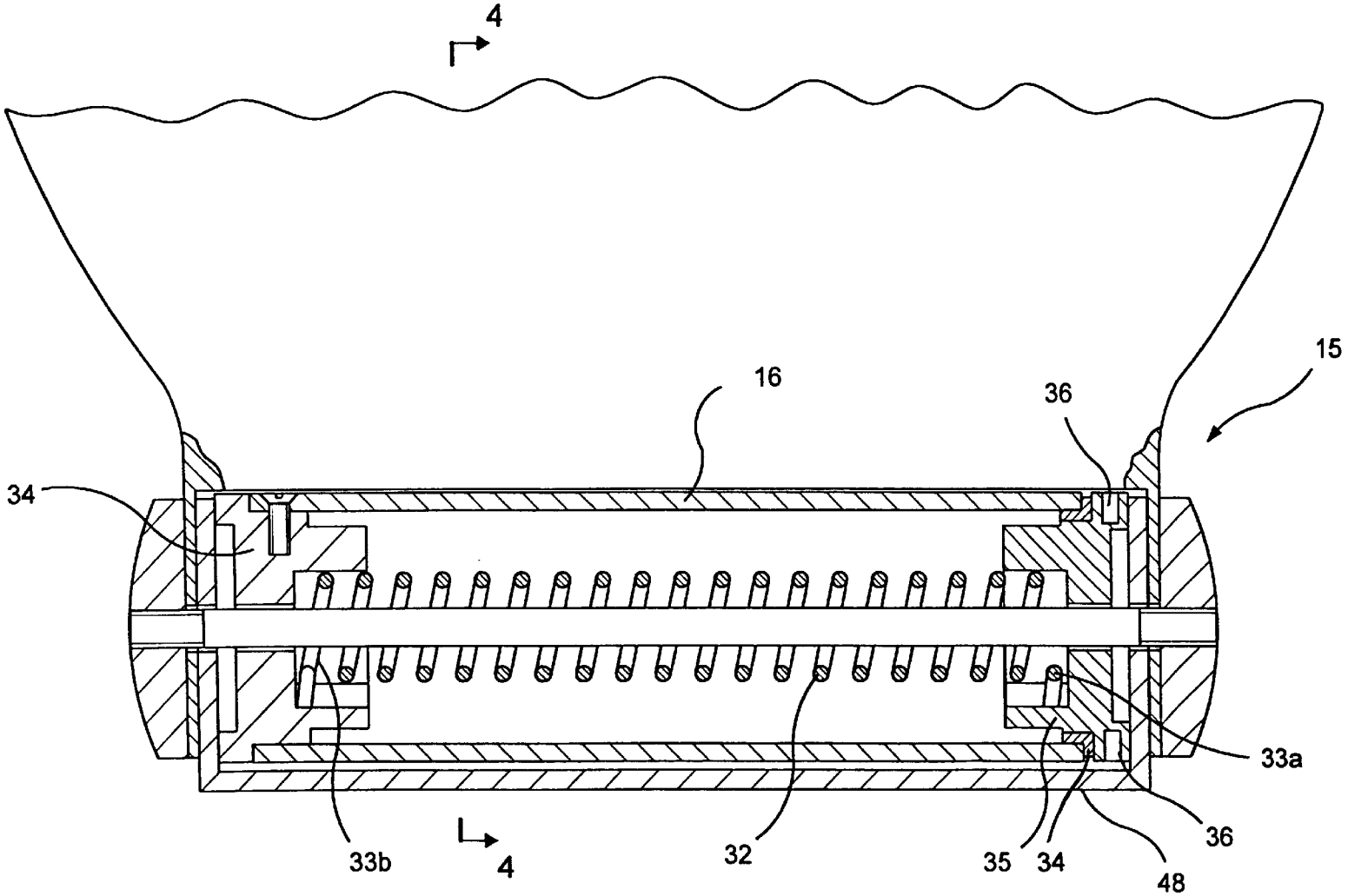
FIG. 3 is a first embodiment of the present invention illustrating the spring mechanism.

FIGS. 3 and 4 illustrate a first embodiment of the present invention. In FIG. 3 the spring mechanism 15 has a cylindrical housing 16 encasing a main spring 32, the main spring 32 has two ends 33*a*, 33*b*, one end 33*a*, is connected by bearings 34 to an adjusting holder 35 having a number of slots or apertures 36 into which a lever or a rod 45 (see FIG. 6A) can be inserted to tighten or loosen the spring 32 thus varying the tension of the spring 32 and changing its resiliency. The other end 33*b* is connected to an end of the cylinder 16 which has an aperture or detente 17 into which the retractable bolt 28 can be inserted or retracted to maintain or release the spring mechanism 15 accordingly so that when the bolt 28 is retracted the cylinder 16 rotates in a direction toward the where the bolt 28 was so that the toilet seat 5 rises. The speed at which the toilet seat 5 rises depends upon how far the rod is turned upon insertion into the aperture 36 and in which direction. If rotated in a first direction as illustrated by the arrow shown in FIG. 7A then the spring 32 is tightened more and more as the rod 45 is moved in that direction and is the resiliency of the spring is lessened when the rod 45 is rotated in a second direction opposite that shown by the arrow of FIG. 6A element is inserted.

FIGS. 5, 7 and 8 show a second embodiment of the present invention in which the bolt 28 is encased almost entirely within its housing 24. This provides for a more compact arrangement of the components and permits easier for repair and replacement of the components of the invention.

FIGS. 6A and 6B describe the structure of the holder 35 for the cylinder 16 and how the spring mechanism 32 is engaged for operational use or disengaged or the resilience of the spring mechanism 32 is varied for varying the speed at which the toilet seat rises. The end of the spring 32 which can be a coil spring 32 are attached to the ends of the cylinder housing 16. By rotating the cylinder housing 16 in one direction the spring is rotated and the resiliency is varied which in turn causes the seat to rise faster or slower depending on whether the resiliency is increased or decreased. Each of the apertures 36 in the cylinder housing 16 can accommodate the rod 45 which can be inserted into the aperture 36 as shown in FIG. 6A.

As shown in FIG. 6A when the rod 45 is tuned in the direction of the arrow the spring 32 is tightened, its resiliency increased and the seat will lift faster. The further one turns in that direction the more the resiliency is increased and the faster the seat will rise. Alternatively, rotating the rod 45 in the opposite direction will decrease the resiliency and slow down the speed at which the seat rises.

In FIG. 6B a key 46 is shown which is inserted into one of the apertures 36 in the holder 35 near the base of the holder 35 near the underside of the toilet seat. The key 46 must be removed when tightening the spring as describe above in connection with FIG. 6A with the rod 45 and the key 46 must be put back in place in the aperture 36 at the base 48 before removing the rod 45 with the key 46 placed back at the base 48 of the holder 35 for the housing cylinder 16 in order to keep the lifting device operational.

In operation the invention operates as follows: Upon flushing the wire 19 connected to the flushing mechanism is pulled which in turn causes the wire 19 to pull on the attached ecable 18 whose other end then pulls back on the back end 26 of the piston 28*a* causing the bolt 28 to retract from its first position within the detente 17 of the housing cylinder 16 of the spring mechanism 15 to the bolt's second position. This retraction by the bolt 28 releases the spring mechanism 15 and permits the housing cylinder to rotate in the direction of the arrow shown in FIG. 7A so that the toilet seat 5 which is attached to the housing cylinder (as shown in FIGS. 1 and 8) will rise up. The toilet seat 5 can be pulled down causing the bolt to lock into place in the detente 17 of the housing cylinder.

In addition the present invention includes a urine spread guard 43 (see FIG. 2) to help hygienically maintain care of the toilet facility.

While presently preferred embodiments have been described for purposes of the disclosure, numerous changes in the arrangement method steps and apparatus parts can be made by those skilled in the art. Such changes are encompassed within the spirit of the invention as defined by the appended claims.

What is claimed is:

1. A toilet seat lifting device adapted to lift a toilet seal from a seated position to a raised position upon flushing, comprising:

a spring mechanism adapted to lift a toilet seat when said spring mechanism is released;

a bolting mechanism for retaining aid spring mechanism from being released when said bolting mechanism is in first position and for releasing said spring mechanism when said bolting mechanism is in second position;

a cable having a first end connected to said bolting mechanism by a wire to a flushing apparatus so that when said flushing apparatus is flushed said wire moves said bolting apparatus from its first position to its second position releasing said spring mechanism so that said toilet seat is raised upward;

said spring mechanism includes a spring, a housing cylinder for housing said spring therein, said spring being connected at each of its ends to each respective end of cylinder and a holder having a base aperture for holding one end of said spring connected to one end of said cylinder and a rod for insertion into one of said apertures to turn said spring and either increase or decrease the resiliency of the spring to vary the speed at which said seat is lifted when said bolting mechanism is retracted from said spring mechanism, said cylinder being connected to said toilet seat so as to rotatably lift said seat when said spring mechanism is released; and a key located at said aperture of said base of said holder and adapted to be removed when tightening said spring with said rod and being adapted to stay in said aperture of aid base before removing said rod to maintain tension of said spring so that said lifting device is operational.

2. The toilet seat lifting device according to claim 1 wherein said spring mechanism is an adjustable spring mechanism whose resilience is adjustable in order to vary a speed at which the toilet seat is raised over a range of speeds from a slow speed to a fast speed.

3. The toilet seat lifting device according to claim 2 wherein said adjustable spring mechanism is adapted to be disengaged to prevent said toilet seat from rising upward following flushing.

4. The toilet seat lifting apparatus according to claim 1 further comprising a urine spread guard.

5. The toilet seat lifting apparatus according to claim 1 wherein said spring mechanism includes a spring, a housing cylinder for housing said spring therein, said spring being connected at each of its ends to each respective end of cylinder and a holder having apertures for holding one of said spring connected to said one end of said cylinder and a rod for insertion into a one of said apertures to turn said spring and either increase or decrease the resiliency of the spring to vary the speed at which said seat is lifted when said bolting mechanism is retracted from said spring mechanism.

6. The toilet seat lifting device according to claim 1 wherein said bolting mechanism is a spring biased catch which locks into a detent of said housing cylinder and which is retracted therefrom when said flushing apparatus pulls said cable causing said bolt to retract out of said detent and thereby causing said seat to lift up.

* * * * *